US007979963B2

(12) United States Patent
Lee-Holowka et al.

(10) Patent No.: US 7,979,963 B2
(45) **Date of Patent: *Jul. 19, 2011**

(54) EYEGLASS AND OTHER PERSONAL ITEMS HOLDER

(76) Inventors: Janice Lee-Holowka, London (GB); Patricia Lee, New York, NY (US); Marc Lester, New York, NY (US)

( * ) Notice: Subject to any disclaimer, the term of this patent is extended or adjusted under 35 U.S.C. 154(b) by 759 days.

This patent is subject to a terminal disclaimer.

(21) Appl. No.: 12/017,680

(22) Filed: Jan. 22, 2008

(65) Prior Publication Data

US 2008/0109999 A1 May 15, 2008

Related U.S. Application Data

(63) Continuation-in-part of application No. 11/392,560, filed on Mar. 30, 2006, now Pat. No. 7,487,574.

(51) Int. Cl.
*A44B 99/00* (2010.01)
*A45F 5/02* (2006.01)

(52) U.S. Cl. ..... 24/3.1; 24/3.13; 24/3.8; 2/1; 224/269; 224/251

(58) Field of Classification Search ..... 24/3.3, 24/3.13, 3.4, 3.8; 224/269, 251; 2/1
See application file for complete search history.

(56) References Cited

U.S. PATENT DOCUMENTS

| | | | | |
|---|---|---|---|---|
| 2,284,069 | A | | 5/1942 | Robertson |
| 2,297,661 | A | | 9/1942 | Okun |
| 2,457,195 | A | | 12/1948 | Bagnall, Jr. |
| 2,572,889 | A | | 10/1951 | Strykower |
| 4,257,463 | A | * | 3/1981 | Monaco ..... 150/111 |
| 4,558,495 | A | * | 12/1985 | Olsen ..... 24/298 |
| 4,894,887 | A | | 1/1990 | Ward, II |
| 4,985,968 | A | * | 1/1991 | Hooper ..... 24/302 |
| 4,991,236 | A | | 2/1991 | Pritchett |
| 5,033,612 | A | | 7/1991 | Bivins |
| 5,304,934 | A | * | 4/1994 | Laskaris et al. ..... 324/318 |
| 5,351,098 | A | | 9/1994 | McDaniels et al. |
| 5,394,592 | A | | 3/1995 | Quick |
| 5,491,878 | A | | 2/1996 | Janouschek |
| 5,540,367 | A | * | 7/1996 | Kauker ..... 224/269 |
| 5,551,126 | A | | 9/1996 | Wallo |
| 5,702,039 | A | * | 12/1997 | Olaiz ..... 224/251 |
| 5,860,191 | A | | 1/1999 | Sieger |
| 5,893,198 | A | | 4/1999 | DeCotis |
| 5,956,812 | A | | 9/1999 | Moennig |
| 7,487,574 | B2 | * | 2/2009 | Lee-Holowka et al. ..... 24/3.13 |
| 2004/0149795 | A1 | | 8/2004 | Szarek |

* cited by examiner

*Primary Examiner* — Robert J Sandy
(74) *Attorney, Agent, or Firm* — Pillsbury Winthrop Shaw Pittman LLP

(57) ABSTRACT

A holder for securing eyeglasses, sunglasses or other personal items that may be securely incorporated into an article of clothing at the time the article is manufactured. The holder includes a base member that can be inserted into an article of clothing. The base member can be securely attached to/by a fastening device. The fastening device may have one end threaded through the article of clothing and securely affixed to the base member and the other end securely affixed to the external part of the holder. The external part of the holder can include a hanger with a support base and a loop. The holder allows a wearer to insert a temple piece of a pair of eyeglasses, or a hook attached to another personal item, through the loop and allows the item to assume a secure and relatively flat position against the wearer's body. The holder may also in include an RFID tag. The holder may also include a covered loop. The covering may be either internal or external. The covering may include a design, logo or monogram.

51 Claims, 4 Drawing Sheets

EYEGLASS AND OTHER PERSONAL ITEMS HOLDER

This application is a continuation-in-part of application Ser. No. 11/392,560, filed Mar. 30, 2006.

BACKGROUND OF THE INVENTION

1. Field of the Invention

This invention relates to a holder for personal items, and more particularly, to an eyeglass holder that can be incorporated into an article of clothing, preferably at the time the article of clothing is manufactured.

2. Description of Related Art

Eyeglass holders have generally comprised a case or pouch for storing unworn eyeglasses, which the user normally carries in a pocket, purse or pouch. Some types of eyeglass holders have been in the form of a cord or decorative necklace with loops at the opposite ends of the cord for receiving a temple piece of the eyeglasses, which may be worn around the user's neck.

Other versions of eyeglass holders that are purchased separately and are temporarily attached by the user to an article of clothing are disclosed in U.S. Pat. Nos. 5,551,126; 5,491,878; 5,956,812; 5,033,612; 4,894,887; 5,351,098; 5,860,191; and 5,893,198. Eyeglass holders of the type disclosed in U.S. Pat. No. 5,551,126 require that the user attach a hanger to an article of clothing using a button that is sewn onto the front of a garment. Eyeglass holders of the type disclosed in U.S. Pat. Nos. 5,491,878 and 5,956,812 use a clip or a clamp for fastening a receiver and a holder to the desired article of clothing. Eyeglass holders of the type disclosed in U.S. Pat. No. 5,033,612 utilize a removable non-clip pin, which requires the user to perforate the garment at each wearing. Eyeglass holders of the type disclosed in U.S. Pat. Nos. 4,894,887, 5,351,098 and 5,860,191 use a non-spring tension-dependent folding type clip or a combination of a clothespin type holder and a spring clip. An eyeglass holder of the type disclosed in U.S. Pat. No. 5,893,198 uses a pivotal swivel holder that embodies an ornamental necklace, which is worn around the user's neck.

The prior art eyeglass holders may require the user to purchase a discrete holder or multiple discrete holders, which may alter the design of an article of clothing, damage the fabric and damage the temple piece of the eyeglass. Moreover, these designs may require the user to not only purchase the holder(s) separately from the article of clothing, but also to attach the holder to the garment, often at each wearing. Additionally, certain designs may limit to a certain thickness the garment to which the holder may be attached. Accordingly, there exists a need for a simple, ready-made and design-incorporated type of eyeglass or other personal item holder that can be securely affixed to an article of clothing, preferably at the time of its manufacture, to resist the unintentional separation of the holder from the article of clothing.

SUMMARY OF THE INVENTION

An embodiment of the invention relates to a holder for supporting a personal item comprising a base member having a first throughhole therethrough, a rotatably mounted cord having a first end inserted through the first throughhole and a hanger comprising a loop and a support base connected to the loop. The support base may be affixed to a second end of the rotatably mounted cord and the base member may be adapted to be inserted into or attached on an article of clothing. The loop may be adapted to support the personal item thereon. The term personal item may include, by way of examples, eyeglasses, sunglasses, a media player such as an iPOD or a mobile phone.

Preferably, a closure device is affixed to the rotatably mounted cord to prevent the rotatably mounted cord from sliding out of the first throughhole. Preferably, the base member is rectangular in shape. In another embodiment, the base member is shaped to conform to a desired space in an article of clothing.

In one embodiment, the first throughhole may be located in any portion of the base member. Preferably, the support base has a second throughhole centered lengthwise and crosswise on the support base and the rotatably mounted cord preferably passes through the second throughhole in a direction substantially perpendicular to the support base. Preferably, the first and second throughholes have a diameter greater than the rotatably mounted cord.

In one embodiment, the support base comprises a resilient tubular ring or cylinder having a diameter greater than the loop. In one embodiment, the support base comprises transparent material or material of any color. Preferably, the loop is a covered fabric elastic loop approximately 0.5" in diameter extending to approximately 1.5" when fully extended. Preferably, the loop is made of formed resilient materials such as metal, fabric or plastic. In one embodiment, the loop comprises transparent material or material of any color. Preferably, the loop is formed to accommodate a temple piece of an eyeglass or a hook attached to another personal item. In one embodiment, the loop is shaped to resemble a manufacturer's logo or other ornamental shape.

In one embodiment, the rotatably mounted cord is looped through a needle to facilitate the perforation of a garment without damaging the fabric and to facilitate threading through the base member. Preferably, the rotatably mounted cord comprises metallic, plastic or fabric wire, cable, line or twine.

Preferably, the holder further comprises a resilient closure for securely affixing the base member to the hanger. Preferably, the base member comprises resilient fabric, plastic or metal material. Preferably, the support base comprises resilient fabric, plastic or metal material. In one embodiment, the support base is shaped to resemble a manufacturer's logo or other ornamental shape. In another embodiment, the base member comprises transparent material or material of any color.

Preferably, the closure device is rectangular and greater in size than the first throughhole in the base member. In one embodiment, the closure device is shaped to resemble substantially a clip such as that tie-pin and is greater in size than the first throughhole in the base member.

Yet another embodiment relates to a method of manufacturing a holder comprising a hanger comprising a loop and a support base connected to the loop, the method comprising affixing a first end of a rotatably mounted cord to a base member; affixing a second end of the rotatably mounted cord to the support base; and affixing the base member into or on an article of clothing during manufacture of the article of clothing, wherein the loop is adapted to support a personal item thereon. Preferably, said providing a rotatably mounted cord having a first end further comprises affixing a closure device to the rotatably mounted cord. The method could further comprise affixing the rotatably mounted cord via a throughhole in said support base; passing said rotatably mounted cord through an article of clothing; and securing said base member to said article of clothing. Preferably, the rotatably mounted cord is looped with a needle through the article of clothing without damaging the article of clothing and facilitating threading through the base member. Preferably, said affixing said first end of said rotatably mounted cord to said base member comprises traversing the first end of said rotatably mounted cord through a through hole in the base member. Preferably, said affixing said first end of said rotatably mounted cord to said base member comprises attaching the first end of said rotatably mounted cord to the base member.

Another embodiment of the invention includes a holder for supporting a personal item comprising a base member, a rotatably mounted cord having a first end of the rotatably mounted cord affixed to the base member; and a hanger comprising a loop and a support base connected to the loop, the support base being affixed to a second end of the rotatably mounted cord, wherein the base member is adapted to be inserted into or attached on an article of clothing and the loop is adapted to support the personal item thereon and an RFID tag.

Still another embodiment of the invention includes A holder for supporting a personal item comprising a base member, a rotatably mounted cord having a first end of the rotatably mounted cord affixed to the base member; and a hanger comprising a loop and a support base connected to the loop, the support base being affixed to a second end of the rotatably mounted cord, wherein the base member is adapted to be inserted into or attached on an article of clothing and the loop is adapted to support the personal item thereon, and wherein the loop comprises an external cover or internal filling.

Another embodiment of the invention includes a method for a holder comprising affixing a first end of a rotatably mounted cord to a support base member, the support member having a loop attached thereto, affixing a second end of the rotatably mounted cord to the support base, affixing the base member into or on an article of clothing during manufacture of the article of clothing, and affixing an RFID tag to the base, wherein the loop is adapted to support a personal item thereon.

Additional advantages of this invention will become readily apparent to those skilled in this art from the following detailed description, wherein only the preferred embodiment of this invention is shown and described, simply by way of illustration of the best mode contemplated for carrying out this invention. The drawings and description are to be regarded as illustrative in nature and not as restrictive.

BRIEF DESCRIPTION OF THE DRAWINGS

These and other features, aspects and advantages of the present invention will become better understood with regard to the following description, appended claims and accompanying drawings where:

For purposes of clarity and brevity, like elements and components will bear the same designations and numbering throughout the Figures.

DETAILED DESCRIPTION OF THE INVENTION

An embodiment of this invention can be to provide a holder that is inherently simple in construction and inexpensive to manufacture, and is convenient in operation for the wearer.

Another embodiment of this invention can be to provide a holder that is incorporated into or attached on and securely affixed to an article of clothing, preferably at the time of the article's manufacture.

Another embodiment of this invention can be to provide a holder that can be relatively unobtrusive, or, alternatively, in the form of a manufacturer's logo, depending on the desired design of the article of clothing.

Another embodiment of this invention can be to provide a holder that can be readily and securely affixed to any part of an article of clothing, such as a pocket, placket band, sleeve, collar or belt loop without damaging the fabric or altering the design of the garment.

Another embodiment of this invention can be to provide a holder with an elastic loop that is sufficiently flexible to accommodate a wide range of thicknesses of temple pieces of eyeglasses and can pivotally rotate to firmly secure the eyeglasses to resist an unintentional separation of the eyeglasses from the holder.

Another embodiment of this invention can be to provide a holder with an elastic or resilient loop that can accommodate a hook attached to another type of personal item and can pivotally rotate to firmly secure the item to resist an unintentional separation of the item from the holder.

The foregoing embodiments and other features and advantages are attained by a holder having a base member that is simple in construction and can be readily, unobtrusively and inexpensively inserted into or attached on an article of clothing, preferably at the time of the article's manufacture, to firmly secure the holder to the garment. The base member may be securely attached through a throughhole to a cord having one end threaded through the article of clothing and securely affixed to the base member and the other end securely affixed to the external part of the holder. The external part of the holder can include a hanger, itself comprised of a support base, and in one embodiment, a flexible elastic loop in the shape of a circle or oval. This flexible elastic loop can be made in various sizes, with one embodiment being approximately 0.5" and extending up to approximately 1.5" when the elastic is fully extended. Both the support base and the loop can also be customized to embody a manufacturer's logo. The hanger is designed so that the user can insert the temple piece of a pair of eyeglasses, or a hook attached to another type of personal item. The eyeglasses or other personal item can then assume a flat position relative to the person's body. This design can also provide for a pivotal rotation to resist the unintentional separation of the eyeglasses or other item from the holder, even as the user moves.

Figure 1:
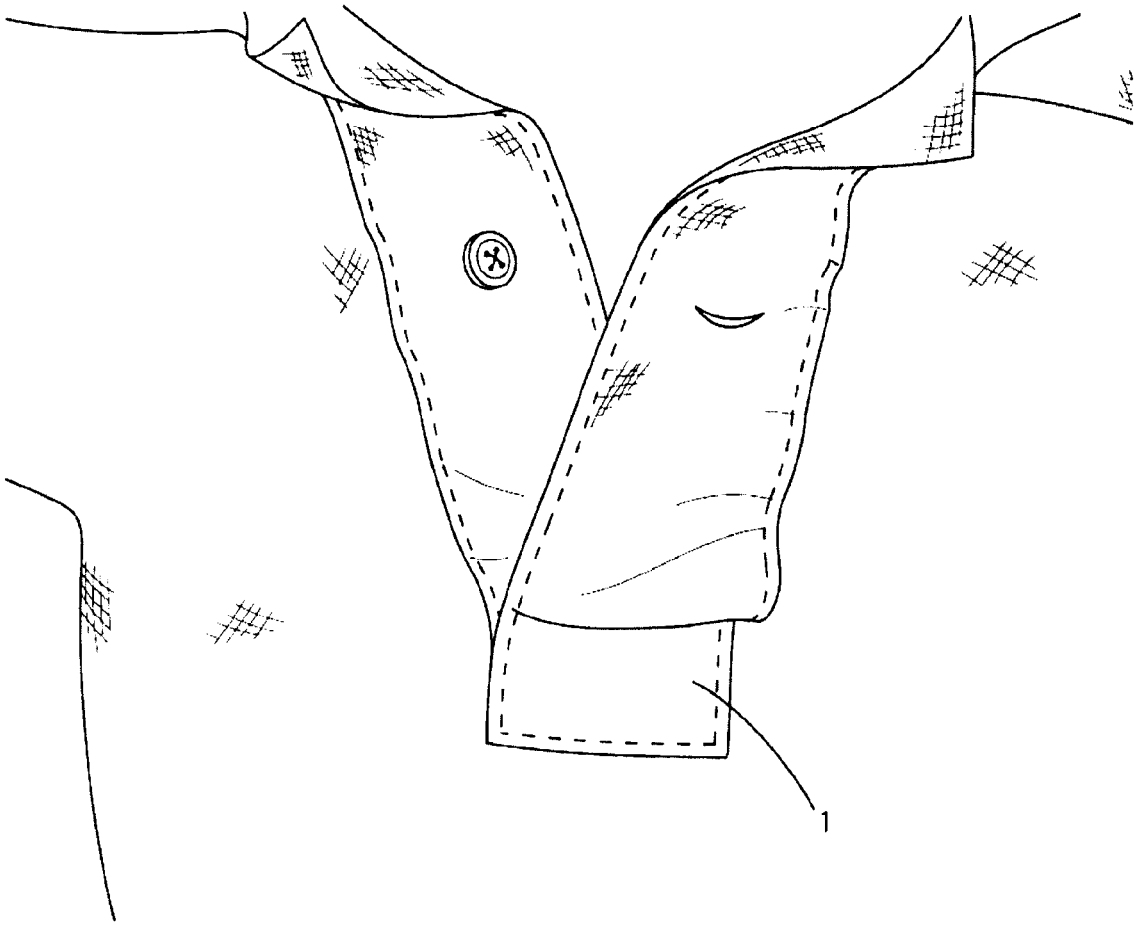
Fig. 1 (Prior Art)
FIG. 1 shows a perspective view of the front of a typical golf shirt (prior art).

FIG. 1 shows a golf shirt of familiar design. Such a design typically has a generally rectangular-shaped area 1 at the bottom of the front closure where garment material is folded and sewn together.

Figure 2:
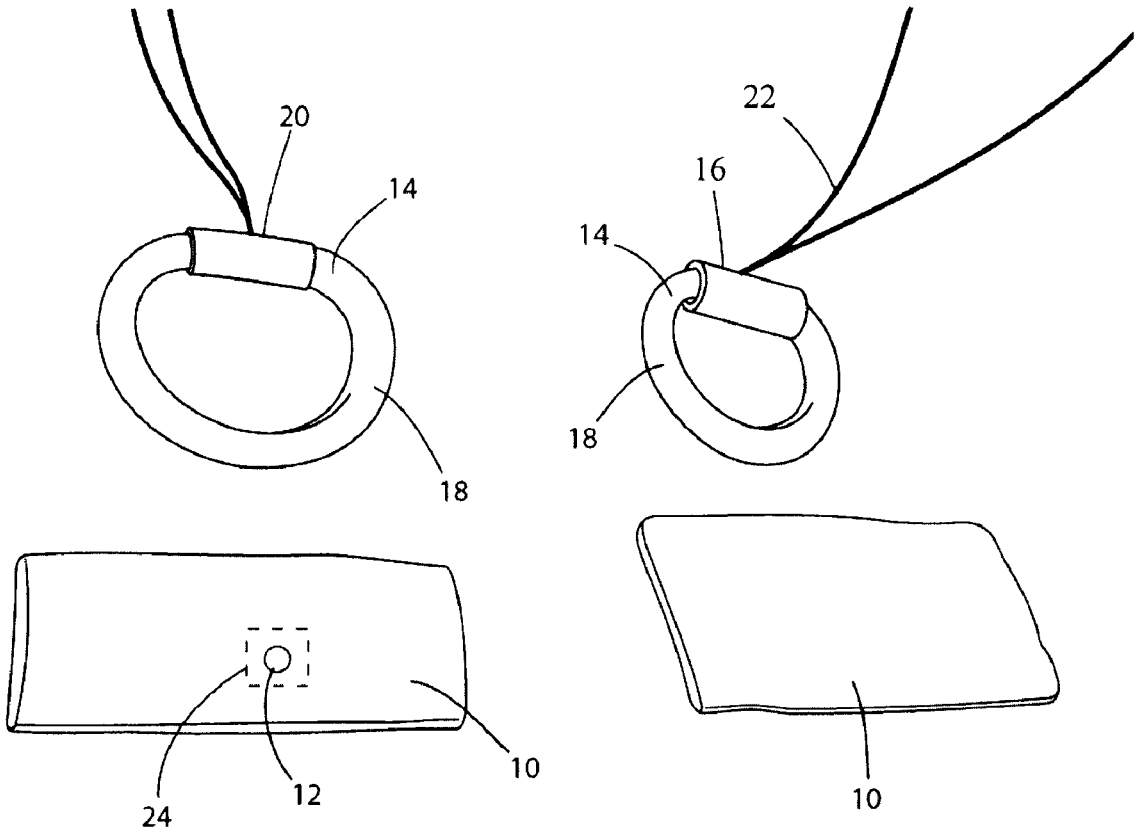
FIG. 2 shows a perspective view of one embodiment of the holder according to the present invention.

FIG. 2 shows an example of one embodiment of the eyeglass or other personal items holder. In FIG. 2, the holder comprises a base member 10 with a first throughhole 12. The base member 10 may be rectangular or shaped to conform to the desired space in an article of clothing, such as the generally rectangular-shaped area 1 shown in FIG. 1. The base member 10 may be made of transparent material, or material of any color. Suitable materials for base member 10 may be resilient fabric, plastic or metal. The first throughhole 12 may be located in any portion of the base member 10.

The holder also has hanger 14 comprising a support base 16, which connects to a loop 18. The support base 16 may include a resilient tubular ring or cylinder having a diameter greater than the loop 18 to affix to loop 18. Loop 18 may be formed to accommodate the temple piece of an eyeglass or a hook attached to another personal item. Loop 18 may be made of transparent material or material of any color. Suitable materials for loop 18 may be resilient materials such as metal, fabric or plastic. Loop 18 may be a covered fabric elastic loop, preferably around 0.5" in diameter extending to around 1.5" when fully extended. The support base 16 may be made of transparent material, or material of any color. Suitable materials for support base 16 may be resilient fabric, plastic or metal. The support base 16 and loop 18 may be shaped to resemble a manufacturer's logo or other ornamental shape.

Connected to the support base 16 through a second throughhole 20 is a cord 22 having one end that is securely affixed to the support base 16, and threaded through the first throughhole 12 in the base member 10 on the other end. The second throughhole 20 may be centered lengthwise and crosswise on the support base 16 to allow cord 22 to pass through the second throughhole 20 in a direction substantially perpendicular to the support base 16. The cord 22 may be rotatably mounted to resist an unintentional separation of the item from the holder by pivotally rotating when the wearer moves.

The hanger 14 can be securely affixed to the base member 10, which has been inserted into an article of clothing, preferably at the time the article of clothing is manufactured, using a closure 24, which in one embodiment can be rectangular and greater in size than the first throughhole 12 in the base member 10. In another embodiment, closure 24 can be shaped into substantially a clip shape.

Using cord 22, the hanger 14 is threaded through the article of clothing. It can be threaded through the first throughhole 12 in base member 10 and the cord 22 can be permanently secured using the aforementioned closure 24 to the base member 10. The cord 22 may have a sharp end, or can be looped through a needle to facilitate the perforation of a garment without damaging the fabric and to facilitate the threading through the base member 10. In one embodiment, the first throughhole 12 in the base member 10 may have the same diameter as the second throughhole 20 in the support base, and both throughholes may be slightly larger than the diameter of cord 22. The remaining cord 22 may be cut and discarded. Cord 22 may be wire, cable, line or twine. Suitable materials for cord 22 may be metal, plastic or fabric. The base member 10 may then be sewn into a fold in the fabric of the article of clothing, rendering it practically invisible. The loop 18 and support base 16 may be incorporated directly into an article of clothing, preferably at the time the article of clothing is manufactured.

From the foregoing, it is readily apparent that the holder described is extremely simple in construction, inexpensive to manufacture, and convenient for the user. A myriad of personal items can be securely supported in a manner that will resist the unintentional separation of the item from the holder. The holder may be suitably supported on any part of an article of clothing without damaging the fabric and may be readily adapted to the manner of the design of the garment as dictated by the manufacturer of the article of clothing. The holder described can be worn either in a vertical or horizontal position and may be placed in different positions (e.g., on a pocket, placket band, sleeve, collar or belt loop) on any article of clothing (e.g., a shirt, pair of pants or jacket).

Figure 3:
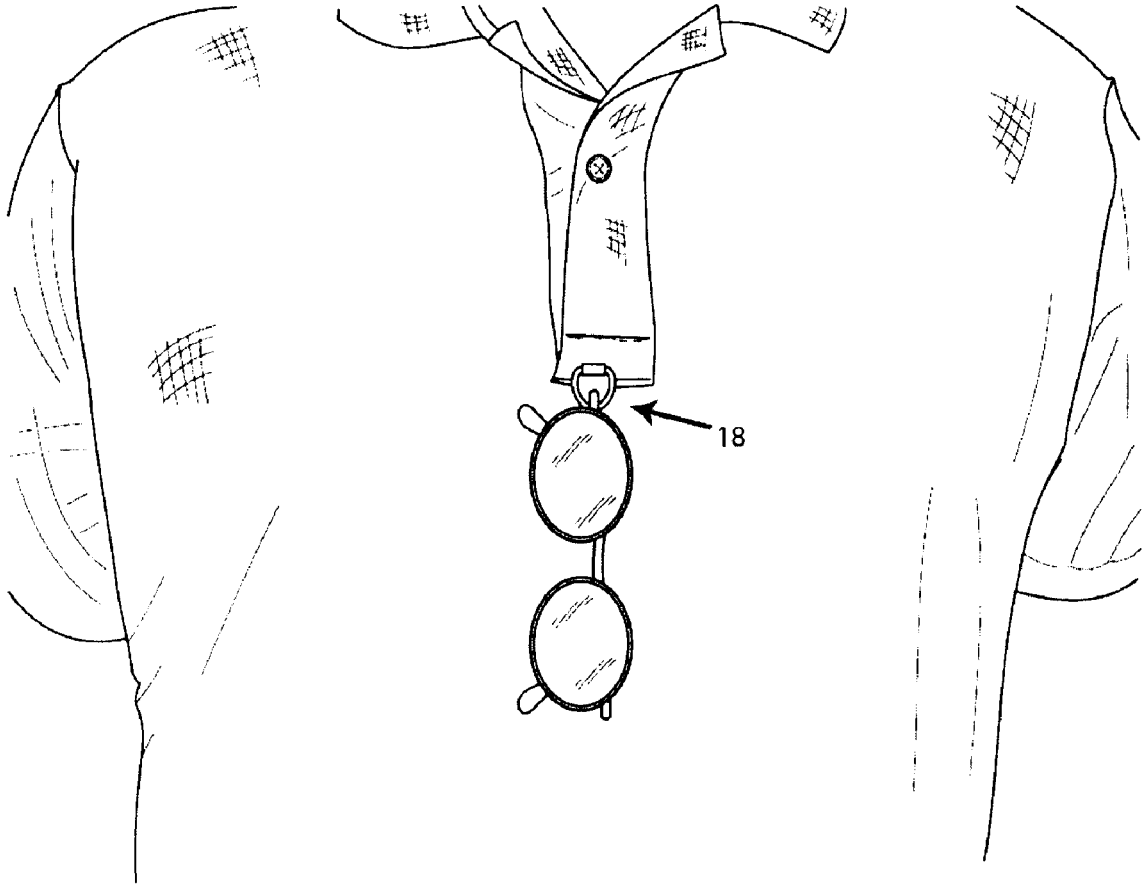
FIG. 3 shows a perspective view of one embodiment of the holder and eyeglasses supported therein according to the present invention.
Figure 4:
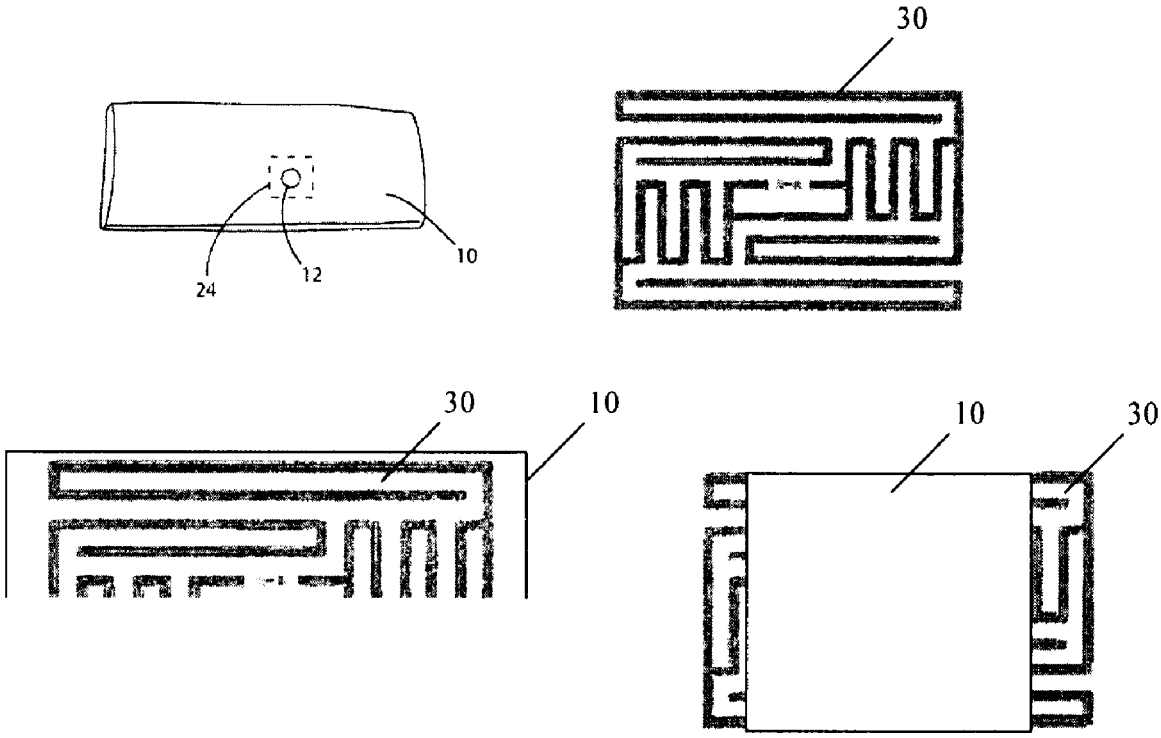
FIG. 4 shows a schematic view of one embodiment of the invention.

FIG. 3 shows an embodiment as an eyeglass holder. The base 10 member is underneath the fold in the garment (within the rectangular area containing loop 18) and is not visible from either the front or the back because it is encompassed within the fold in the garment. FIG. 4 shows another embodiment of the invention. This embodiment includes a radio frequency identification (RFID) tag 30. An RFID tag 30 is an object that can be applied to or incorporated into a product for the purpose of identification using radiowaves. Some RFID tags 30 can be read from several meters away and beyond the line of sight of the reader. Most RFID tags 30 contain at least two parts. One is an integrated circuit for storing and processing information, modulating and demodulating a (RF) signal and can also be used for other specialized functions. The second is an antenna for receiving and transmitting the signal. A technology called chipless RFID allows for discrete identification of tags without an integrated circuit, thereby allowing tags to be printed directly onto assets at lower cost than traditional tags In one aspect of the invention, the RFID tag 30 is wrapped inside base member 10. In another aspect of the invention, the base member 10, is wrapped with the RFID tag 30. In still another aspect of the invention, the RFID tag 30 is attached to either the front or the back of the base member 10. Preferably, that addition of the RFID tag 30 does not alter the functionality or the design of the holder. However, the design of the base member 10 of the holder may be modified to accommodate the RFID tag 30. With the inclusion of the RFID tag 30 in this embodiment of the invention, it is possible to track inventories. It also provides the possibility to hinder counterfeiting by allowing the identification and tracking of which garments were manufactured by official licensees or third-party manufacturers. Indeed, the present embodiment allows tracking by licensee/manufacturer, plant location, and even batch. It further may function as a security device to help counter theft. Including the RFID tag 30 on/in the base member 10, which is subsequently placed inside of the garment fabric, may prevent the unintentional removal of the label/device prior to its effective use, and may act as a substitution for alternative devices, such as the more unsightly and potentially damaging to the garment fabric hard plastic security tags.

Figure 5:
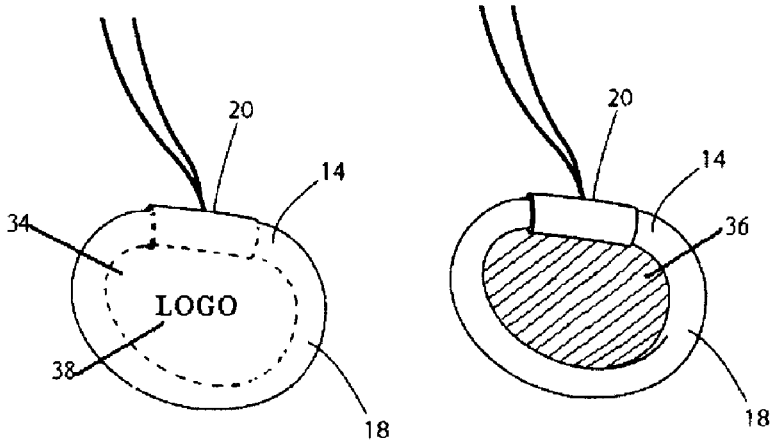
FIG. 5 shows a perspective view of one embodiment of the invention.

FIG. 5 illustrates another embodiment of the invention. This embodiment includes a covered loop 32. The covered loop 32 can be formed with an external cover 34 or internal filling 36. Preferably, the external cover 34 or internal filling 36 comprises a thin fabric which itself can accommodate a design, logo or monogram 38. The external cover 34 or internal filling 36 can also be comprised of a resilient fabric, plastic or metal material. The external cover 34 or internal filling 36 may match the color of the loop 18, be any alternative color or be multiple colors. In one preferred embodiment, the external cover 34 or internal filling 36 is be perforated, for example in quartered or one-third slits, to allow for the easy insertion and removal of the temple piece of an eyeglass or hook attached to another personal item.

Although the present invention has been described with respect to a particular embodiment and illustrating an eyeglass holder as shown in FIG. 3, other alternative versions are possible, particularly those designed to hold sunglasses or other small personal items (e.g., a media player such as an iPOD or a mobile phone). Other variations could include those designed to affix to an article of clothing without the aforementioned base member 10 and cord 22, those intended to affix to an accessory (e.g., a handbag) that is not an article of clothing, or other adaptations using the same or substantially similar features. Therefore, the spirit and scope of the appended claims should not be limited to the description of the versions contained herein. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A holder for supporting a personal item comprising: a base member, a fastening device having a first end of the fastening device affixed to the base member; and a hanger comprising a loop and a support base connected to the loop, the support base being optionally affixed to asecond end of the fastening device, wherein the base member is adapted to be inserted into or attached on an accessory during manufacture of the accessory and the holder is adapted to support the personal item hanging thereon with the base member inserted into or attached on the accessory, wherein the base member has a first through hole there through and the first end of the fastening device is affixed to the base member with the first end of the fastening device traversed through the first through hole, wherein the support base comprises a resilient tubular ring or a cylinder-shaped body having a diameter greater than the loop.

2. The holder of claim 1, further comprising a closure device affixed to the fastening device for preventing the fastening device from sliding out of the first through hole.

3. The holder of claim 1, wherein the base member is shaped to conform to a desired space in or on an accessory.

4. The holder of claim 1, wherein the base member is rectangular or generally rectangular in shape.

5. The holder of claim 1, wherein said first through hole is located in any portion of said base member.

6. The holder of claim 1, wherein the support base comprises transparent material or material of any color.

7. The holder of claim 1, wherein the loop is a covered fabric elastic loop having a diameter of about 0.1" to about 0.5" extending to about 0.25" to about 1.5" when fully extended.

8. The holder of claim 1, wherein the loop is made of formed resilient materials such as metal, fabric or plastic.

9. The holder of claim 1, wherein the loop comprises transparent material or material of any color.

10. The holder of claim 1, wherein the loop is formed to accommodate a temple piece of an eyeglass or a hook attached to another personal item.

11. The holder of claim 1, wherein the loop is shaped to resemble a manufacturer's logo or an ornamental shape.

12. The holder of claim 1, wherein the fastening device comprises a cord, a wire, a cable, a line, or a twine.

13. The holder of claim 1, wherein the base member comprises a resilient fabric, a plastic, or a metal material.

14. The holder of claim 1, wherein the support base comprises a resilient fabric, a plastic, or a metal material.

15. The holder of claim 1, wherein the support base is shaped to resemble a manufacturer's logo or other ornamental shape.

16. The holder of claim 1, wherein the base member comprises transparent material or material of any color.

17. The holder of claim 1, wherein the hanger is designed to insert the personal item such that the personal item hangs from the hanger and assumes a flat position relative to the accessory.

18. The holder of claim 1, wherein the accessory is a handbag.

19. The holder of claim 1, wherein the second end of the fastening device is affixed to a portion of the accessory.

20. The holder of claim 1, wherein support base comprises the resilient cylinder-shaped body comprising a resilient fabric, plastic, or metal.

21. The holder of claim 1, wherein the fastening device is made of metal, plastic, or fabric.

22. An accessory comprising the holder of claim 1.

23. A holder for supporting a personal item comprising: a base member, a fastening device having a first end of the fastening device affixed to the base member; and a hanger comprising a loop and a support base connected to the loop, the support base being optionally affixed to a second end of the fastening device, wherein the base member is adapted to be inserted into or attached on an accessory during manufacture of the accessory and the holder is adapted to support the personal item hanging thereon with the base member inserted into or attached on the accessory, wherein the base member has a first through hole there through and the first end of the fastening device is affixed to the base member with the first end of the fastening device traversed though the first through hole, wherein a closure device comprises an object that is greater in size than the first through hole in the base member.

24. The holder of claim 23, wherein a closure device is shaped to resemble substantially a rectangular type object, or a clip shaped object, and is greater in size than the first through hole in the base member.

25. An accessory comprising the holder of claim 1.

26. A holder for supporting a personal item comprising: a base member, a fastening device having a first end of the fastening device affixed to the base member; and a hanger comprising a loop and a support base connected to the loop, the support base being affixed to a second end of the fastening device, wherein the base member is adapted to be inserted into or attached on an accessory during manufacture of the accessory and the holder is adapted to support the personal item hanging thereon with the base member inserted into or attached on the accessory, wherein the base member, wherein the base member has no through hole there through and the first end of the fastening device is affixed to the base member with the first end of the fastening device attached to the base member.

27. An accessory comprising the holder of claim 26.

28. A method of manufacturing a holder comprising a hanger comprising a loop and a support base connected to the loop, the method comprising:

affixing a first end of a fastening device to a base member;

optionally affixing a second end of the fastening device to the support base; and affixing the base member into or on an accessory during manufacture of the accessory, wherein the loop is adapted to support a personal item thereon, wherein the support base comprises a resilient tubular ring or a cylinder-shaped body having a diameter greater than the loop.

29. The method of claim 28, wherein providing a fastening device having a first end further comprises affixing a closure device to the fastening device.

30. The method of claim 28, further comprising affixing the fastening device via a through hole in said support base; passing said fastening device through an accessory; and securing said base member to said accessory.

31. The method of claim 28, wherein the affixing said first end of said fastening device to said base member comprises traversing the first end of said fastening device through a through hole in the base member.

32. The method of claim 28, wherein the affixing said first end of said fastening device to said base member comprises attaching the first end of said fastening device to the base member.

33. The method of claim 28, wherein the accessory is a handbag.

34. A method manufacturing an accessory comprising said manufacturing the holder according to claim 28.

35. A method of manufacturing a holder comprising a hanger comprising a loop and a support base connected to the loop, the method comprising:

affixing a first end of a fastening device to a base member;

optionally affixing a second end of the fastening device to the support base; and affixing the base member into or on an, accessory during manufacture of the accessory, wherein the loop is adapted to support a personal item thereon, wherein the fastening device is connected to the accessory without damaging the accessory through the base member.

36. The method of claim 35, wherein the fastening device is looped with a needle through the accessory without damaging the accessory and facilitating threading through the base member.

37. A method manufacturing an accessory comprising said manufacturing the holder according to claim 35.

38. An accessory comprising a holder for supporting a personal item, the holder comprising a base member, a fastening device having a first end of the fastening device affixed to the base member; and a hanger comprising a loop and a support base connected to the loop, the support base being optionally affixed to a second end of the fastening device, wherein the base member is adapted to be inserted into or attached on the accessory during manufacture of the accessory and the accessory is capable of supporting a weight of the personal item hanging from the holder with the base member inserted into or attached on the accessory, wherein the support base comprises a resilient tubular ring or a cylinder-shaped body having a diameter greater than the loop.

39. The accessory of claim 38, wherein the base member has a first through hole there through and the first end of the fastening device is affixed to the base member with the first end of the fastening device traversed through the first through hole.

40. The accessory of claim 39, further comprising a closure device affixed to the fastening device for preventing the fastening device from sliding out of the first through hole.

41. The accessory of claim 38, wherein the base member is shaped to conform to a desired space in or on an accessory.

42. The accessory of claim 38, wherein the loop has a diameter of about 0.1" to about 0.5" extending to about 0.25" to about 1.5" when fully extended.

43. The accessory of claim 38, wherein the accessory is a handbag.

44. The accessory of claim 38, wherein the second end of the fastening device is affixed to a portion of the accessory.

45. The holder of claim 38, wherein support base comprises the resilient cylinder-shaped body comprising a resilient fabric, plastic, or metal.

46. A holder for supporting a personal item comprising: a base member, a fastening device having a first end of the fastening device affixed to the base member; and a hanger comprising a loop and a support base connected to the loop, the support base being optionally affixed to a second end of the fastening device, wherein the base member is adapted to be inserted into or attached on an accessory during manufacture of the accessory and the holder is adapted to support the personal item hanging thereon with the base member inserted into or attached on the accessory, wherein the support base has a second through hole, the second through hole is centered lengthwise and crosswise on the support base and the fastening device passes through the second though hole in a direction substantially perpendicular the support base.

47. The holder of claim 46, wherein the accessory is a handbag.

48. An accessory comprising the holder of claim 46.

49. A holder for supporting a personal item comprising: a base member, a fastening device having a first end of the fastening device affixed to the base member; and a hanger comprising a loop and a support base connected to the loop, the support base being optionally affixed to a second end of the fastening device, wherein the base member is adapted to be inserted into or attached on an accessory during manufacture of the accessory and the holder is adapted to support the personal item hanging thereon with the base member inserted into or attached on the accessory, further comprising a resilient closure for securely affixing the base member to the hanger.

50. The holder of claim 49, wherein the accessory is a handbag.

51. An accessory comprising the holder of claim 49.

* * * * *